US005307789A

United States Patent [19]

Newby

[11] Patent Number: 5,307,789

[45] Date of Patent: May 3, 1994

[54] MULTI-PURPOSE GAS HEATED COOKING APPARATUS

[76] Inventor: Liva M. Newby, 3807 Springbloom Dr., Portsmouth, Va. 23703

[21] Appl. No.: 51,837

[22] Filed: Apr. 26, 1993

[51] Int. Cl.[5] ..... F24C 1/16

[52] U.S. Cl. ..... 126/9 R; 126/25 A; 126/30; 126/40; 126/50; 222/169

[58] Field of Search ..... 126/9 R, 25 R, 41 R, 126/40, 29, 30, 50, 25 A; 222/167, 168, 181; 248/165, 163.1; 99/345, 346, 347

[56] References Cited

U.S. PATENT DOCUMENTS

| | | | |
|---|---|---|---|
| 2,528,312 | 10/1950 | Jorgensen | 126/30 |
| 3,643,838 | 2/1972 | Allen | 222/169 |
| 3,688,757 | 9/1972 | Dusek | 126/9 R |
| 4,061,083 | 12/1977 | Caliva | 222/169 |
| 4,065,085 | 12/1977 | Gellatly | 126/30 |

FOREIGN PATENT DOCUMENTS

| | | | |
|---|---|---|---|
| 967124 | 9/1964 | United Kingdom | 126/50 |

*Primary Examiner*—James C. Yeung
*Attorney, Agent, or Firm*—S. Michael Bender

[57] ABSTRACT

A multi-purpose gas heated cooking apparatus has a framework rack for holding a cooking container to be heated to cook the container's contents. The cooking apparatus has a shelf which can be positioned in a plurality locations within the framework rack for supporting a cooking container and the cooking apparatus has a centrally positioned hook at the top of the framework for hanging a cooking container such as a hanging kettle. A cooking container supported within the apparatus can be heated with propane gas burned in a specially adapted propane gas burner which itself can at least partially support a cooking container. The shelf and the specially adapted propane burner can be positioned in several different ways depending upon the type of cooking to be done and cooking container to be used. The apparatus can be alternately used for frying, stewing in an old-fashioned type kettle, deep-frying in an old-fashioned type kettle, steaming, or grilling.

4 Claims, 4 Drawing Sheets

MULTI-PURPOSE GAS HEATED COOKING APPARATUS

BACKGROUND OF THE INVENTION

1. Field of the Invention

The present invention relates generally to cooking devices, and more particularly, to a propane gas heated cooking apparatus especially adapted for use in a plurality of cooking situations.

2. Description of the Prior Art

Cooking devices in the form of outdoor gas grills are well known. These prior art devices typically can be used in one way, namely to burn gas to heat lava rocks or the like which in turn cook food supported on a metal grill plate above the lava rocks and the gas burner. For examples of prior art gas heated grill devices, see U.S. Pat. Nos. 3,870,031; 4,492,215; 4,823,838; 4,895,131; and 5,070,776.

Thus, while the foregoing body of prior art indicates it to be well known to use gas such as propane for cooking food on a grill, the provision of a more multi-functional yet simple and cost effective device is not contemplated. Nor does the prior art described above teach or suggest a cooking device which may be used by individuals to alternately fry, stew in an old-fashioned type kettle, deep-fry in an old-fashioned type kettle, steam, or grill. The foregoing disadvantages are overcome by the unique cooking apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a gas heated cooking apparatus having a framework rack for holding a cooking container to be heated to cook the container's contents. The cooking apparatus has a shelf which can be positioned in a plurality of locations within the framework rack for supporting a cooking container and the cooking apparatus has a centrally positioned hook at the top of the framework for hanging a cooking container such as a hanging kettle. A cooking container supported within the apparatus can be heated with propane gas burned in a specially adapted propane gas burner which itself can at least partially support a cooking container. The shelf and the specially adapted propane burner can be positioned in several different ways depending upon the type of cooking to be done and cooking container to be used. The apparatus can be alternately used for frying, stewing in an old-fashioned type kettle, deep-frying in an old-fashioned type kettle, steaming, or grilling.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new gas heated cooking apparatus which has all of the advantages of the prior art and none of the disadvantages.

It is another object of the present invention to provide a new gas heated cooking apparatus which may be easily and efficiently manufactured and marketed.

It is a further objective of the present invention to provide a new gas heated cooking apparatus which is of durable and reliable construction.

An even further object of the present invention is to provide a new gas heated cooking apparatus which is susceptible of a low cost of manufacture with regard to both materials and labor, and which accordingly is then susceptible of low prices of sale to the consuming public, thereby making such gas heated cooking device available to the buying public.

Still yet a further object of the present invention is to provide a new gas heated cooking apparatus having a framework rack for holding a cooking container to be heated to cook the container's contents.

It is still a further object of the present invention is to provide a new gas heated cooking apparatus having a shelf which can be positioned in several locations within the framework rack for supporting a cooking container and a centrally positioned hook at the top of the framework for hanging a cooking container such as a hanging kettle.

Even still a further object of the present invention is to provide a means for supporting a cooking container supported within the cooking apparatus such that the cooking container can be heated with propane gas burned in a specially adapted propane gas burner which itself can at least partially support a cooking container.

Still a further object of the present invention is to provide a new gas heated cooking apparatus in which the shelf and the specially adapted propane burner can be positioned in several different ways depending upon the type of cooking to be done and cooking container to be used.

It is yet still a further object of the present invention to provide a multi-purpose cooking apparatus which can be alternately used for frying, stewing in an old-fashioned type kettle, deep-frying in an old-fashioned type kettle, steaming, or grilling.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new gas heated cooking apparatus embodying the principles and concepts of the present invention will be described.

Figure 1:
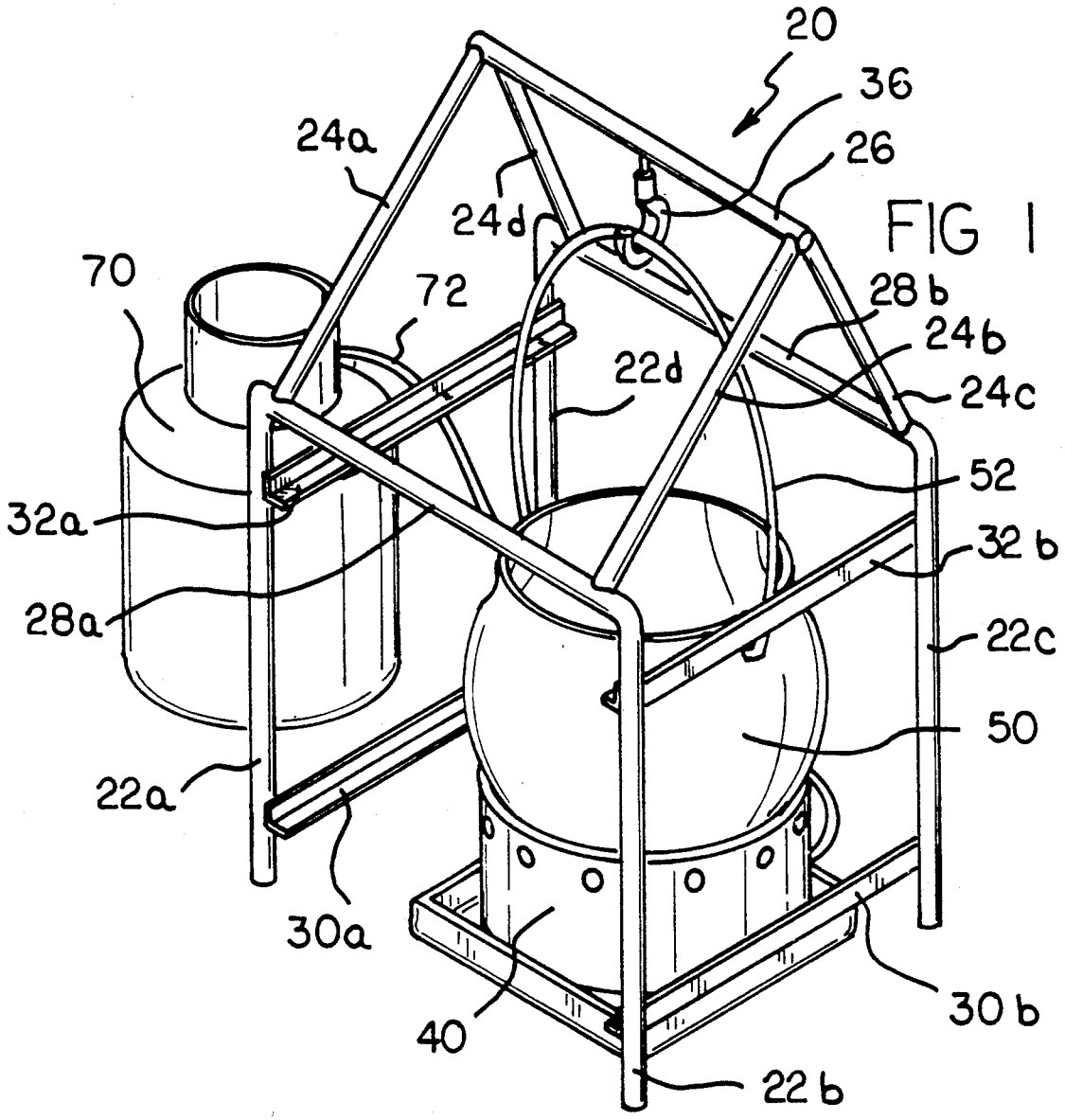
FIG. 1 is a perspective view showing the preferred embodiment of the multi-purpose gas heated cooking apparatus of the present invention arranged for cooking with an old-fashioned type kettle.

Turning initially to FIGS. 1–4, there is shown a first exemplary embodiment of the multi-purpose gas heated cooking apparatus of the invention generally designated by reference numeral 20. In its preferred form, multi-purpose gas heated cooking apparatus 20 (as shown in FIG. 1) comprises a framework made up generally of the following:

four base legs of the framework 22*a*, 22*b*, 22*c*, 22*d*;

four top support legs of the framework 24*a*, 24*b*, 24*c*, 24*d*;

a top bar 26;

two cross supports 28*a* and 28*b* which run between base legs 22*a* and 22*b* and legs 22*c* and 22*d* respectively (in the preferred embodiment as shown in the Figures, a two legs and a cross bar made up of one continuous piece);

two lower shelf supporting cross pieces 30*a* and 30*b* which run between legs 22*a* and 22*d* and between legs 22*b* and 22*c* respectively;

and two upper shelf supporting cross pieces 32*a* and 32*b* which also run between legs 22*a* and 22*d* and between legs 22*b* and 22*c* respectively.

The framework 20 is preferably made of a metal and the various parts are preferably welded together.

A hook 36 strong enough to support a filled large old-fashioned type kettle 50 hangs by means of the kettle's handle 52 from the upper bar 26.

The present invention further comprises a specially adapted propane burner 40 which burns propane provided from a tank like that represented by reference numeral 70 through gas line 72. The burner 40 is shown in more detail in FIG. 4. On/off bar 48' can be turned to open and close on/off valve 48. When the valve 48 is open propane gas can be released into the atmosphere through gas discharge holes 42' in gas exit part 42. The gas exit part 42 is supported within circular support 44, which itself is sturdily supported by rectangular support base 46. By lighting a match when the valve 48 is open, the propane will burn as it exits part 42, heating anything directly above it.

In FIG. 1, the multi-purpose cooking apparatus 20 is shown set up for cooking the contents of a large old-fashioned kettle 50 which hangs from the hook 36 and rests supported on the circular support 40 of the burner 40. Using a kettle 50 the cooking device 20 can be, for example, used to steam, boil, stew, fry or deep fry any type of food.

Figure 2:
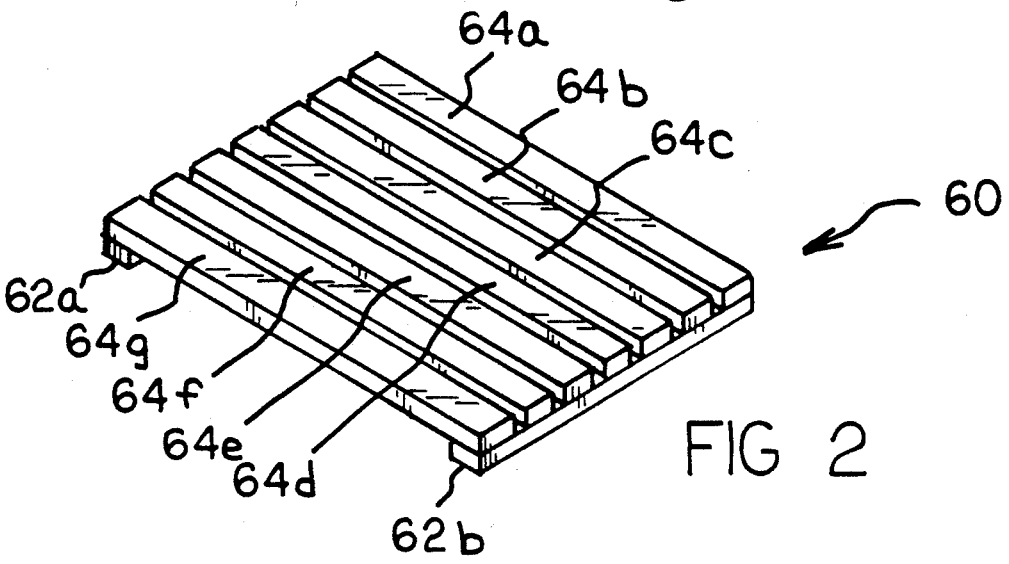
FIG. 2 is a perspective view showing a shelf which can be used with the preferred embodiment of the multi-purpose gas heated cooking apparatus of FIG. 1 in accordance with the present invention.

FIG. 2 shows a shelf 60 which can be used as part of the present invention. The shelf 60 is preferably comprised of two support pieces of wood 62*a*, 62*b* which support seven cross pieces of wood 64*a*, 64*b*, 64*c*, 64*d*, 64*e*, 64*f*, 64*g* (of course any number of pieces can be used and an effective material other than wood can be used within the scope of the present invention).

The shelf 60 is sized to fit between both the two lower shelf supporting cross pieces 30*a* and 30*b* or the two upper shelf supporting cross pieces 32*a* and 32*b*. The set-up of FIG. 1 could have been easily modified by placing the shelf 60 on the lower cross-pieces 30*a* and 30*b* and then burner 40 on top of the shelf 60. This would have raised the kettle 50 slightly higher and would have kept the burner 40 off the ground.

Figure 3:
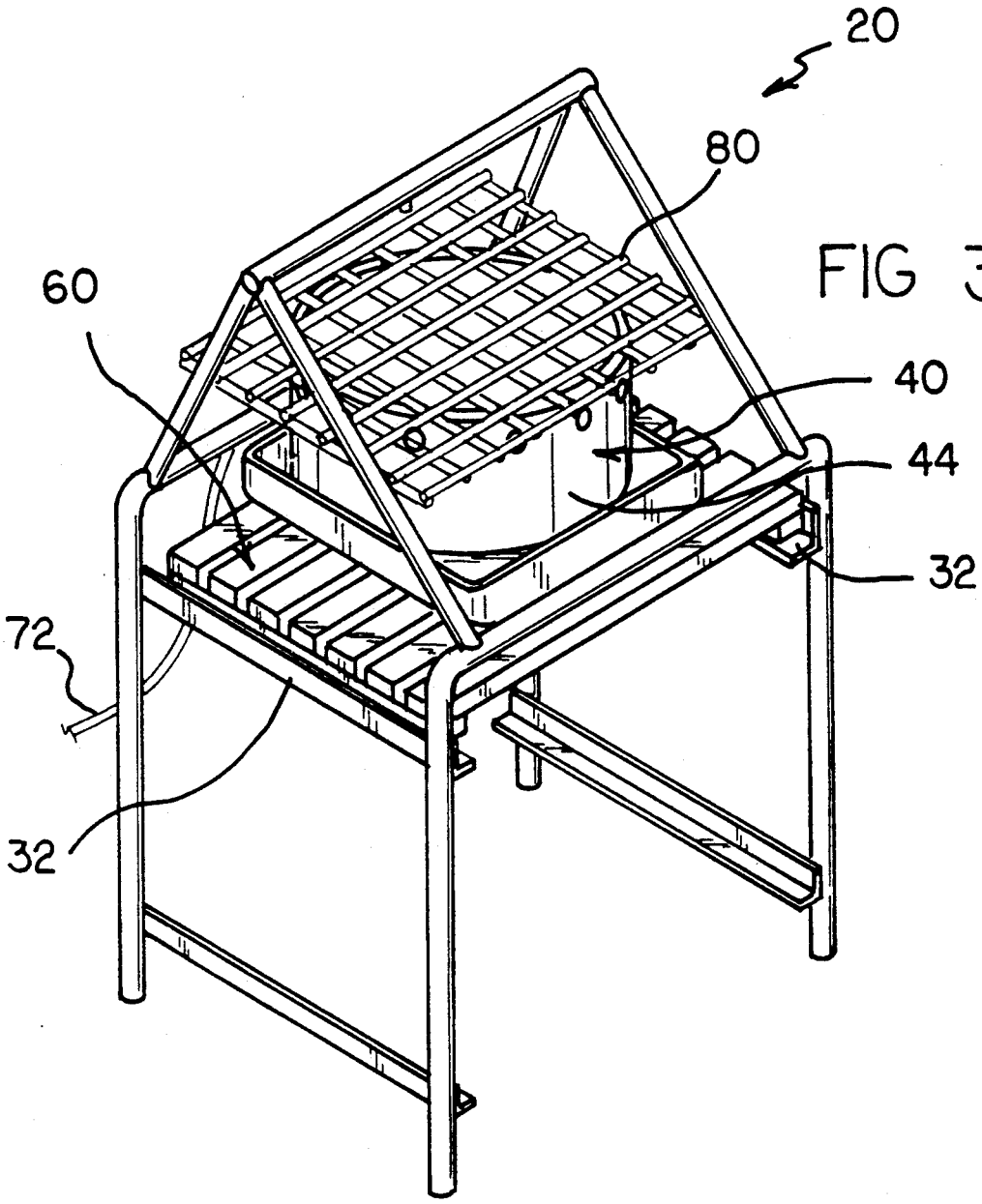
FIG. 3 is a perspective view showing the preferred embodiment of the multi-purpose gas heated cooking apparatus of the present invention arranged for cooking with a standard pot or pan (pot/pan not shown).
Figure 4:
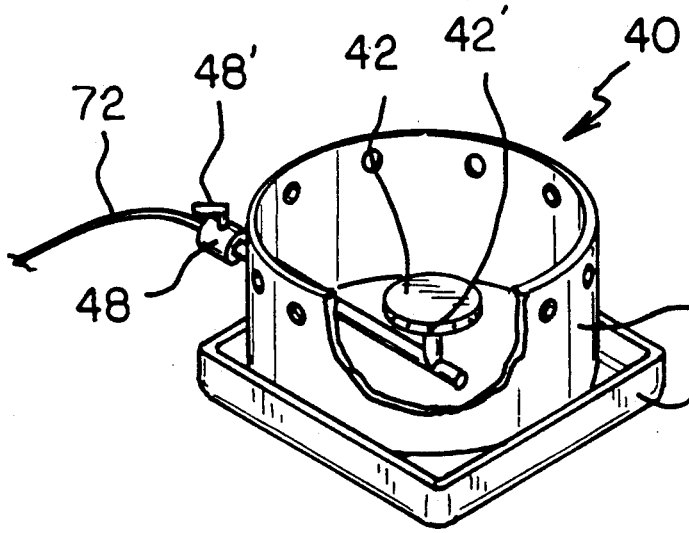
FIG. 4 is a perspective view showing a gas burner specially adapted for use with the present invention in accordance with the present invention.

Now referring to FIG. 3, an alternately arranged gas heated cooking apparatus 20' in accordance with the present invention is shown for use in grilling foods. The apparatus 20' is made of the same equipment as the FIG. 1 apparatus 20 with the addition of the shelf 60 of FIG. 2 and of a grill 80. The shelf 60 is positioned on the two upper shelf supporting cross pieces 32*a* and 32*b* of the framework. The burner 40 is positioned on top of the shelf 60 and the grill 80 is positioned above and supported by the circular support 44 of burner 40.

By using the FIG. 3 set-up of the apparatus 20' foods (meats, etc.) can be grilled on the grill 80.

Figure 5:
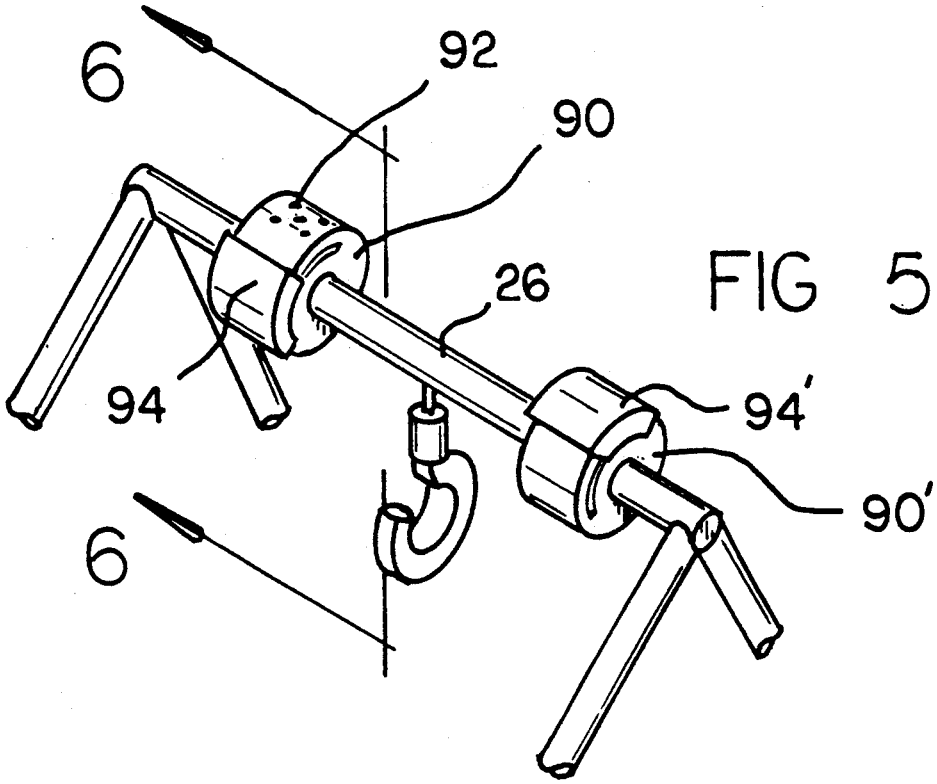
FIG. 5 is a perspective view of an alternative embodiment of a framework cross bar having integral salt and pepper dispensers all in accordance with the present invention.
Figure 6:
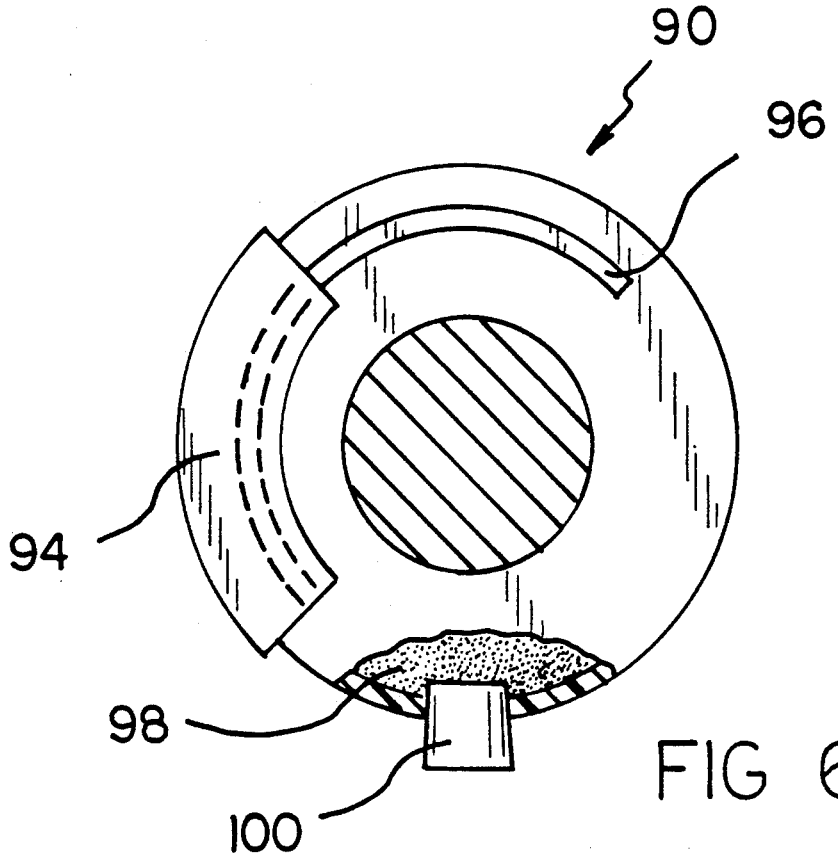
FIG. 6 is a partially cross-sectional side view of the alternative embodiment of the invention taken along 6—6 of FIG. 5.

Turning now to FIGS. 5 and 6, an alternative addition to the present invention is shown. Circular salt and pepper holders 90 and 90' (which can be filled with salt and pepper 98) are positioned on and around the top bar 26. The salt and pepper holders 90 and 90' have small holes 92 for releasing the salt or pepper. Sliding seals 94 and 94' can be used for closing the salt and/or pepper holders. The seal 90 can be supported by and allowed to slide within groove 96. Additional salt or pepper 98 can be added to the holder by removing plug 100, adding the salt or pepper and returning the plug 100.

The salt and pepper holders can be opened (or closed) by sliding seal 94 away from (or over) the holes 92 allowing the salt or pepper to fall onto food being cooked (or covering the holes).

Figure 7:
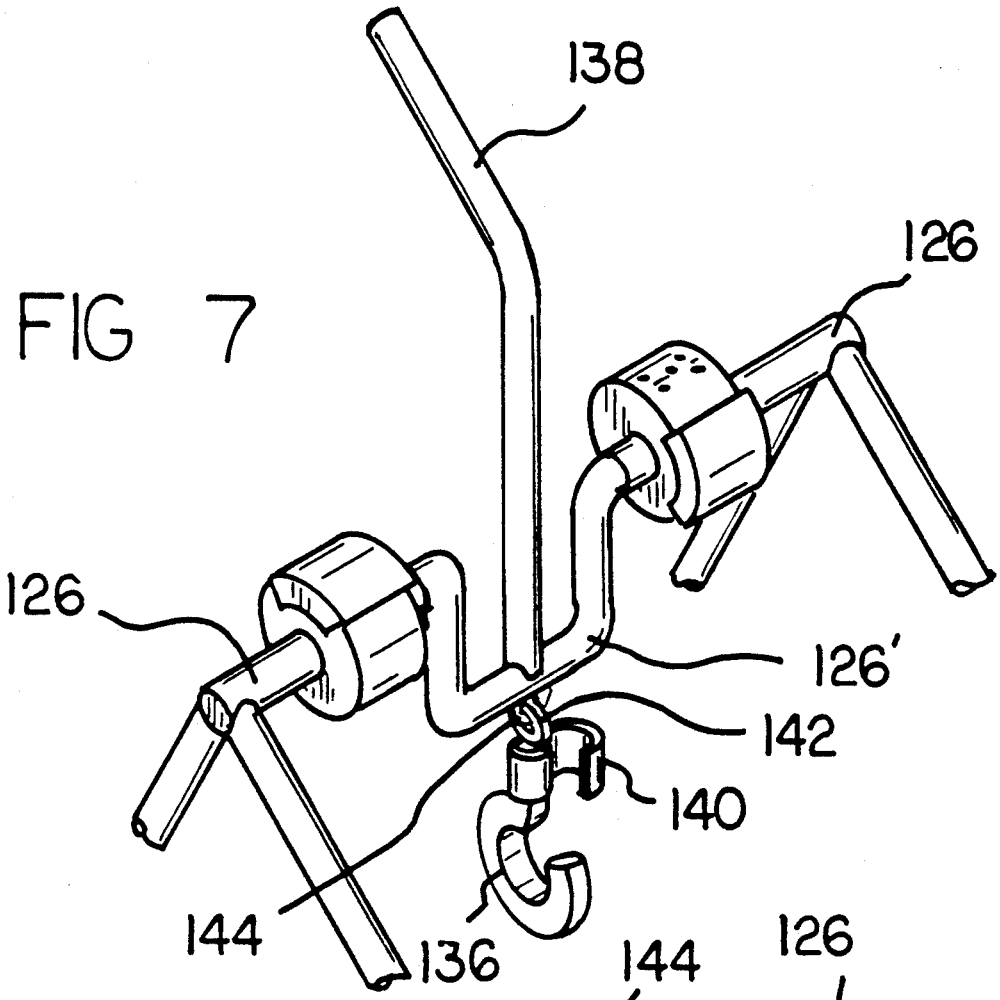
FIG. 7 is a perspective view of another alternative embodiment of a framework cross bar having a bar for lifting a kettle away from the heat (shown in the down and close to the heat position) as well as integral salt and pepper dispensers all in accordance with the present invention.
Figure 8:
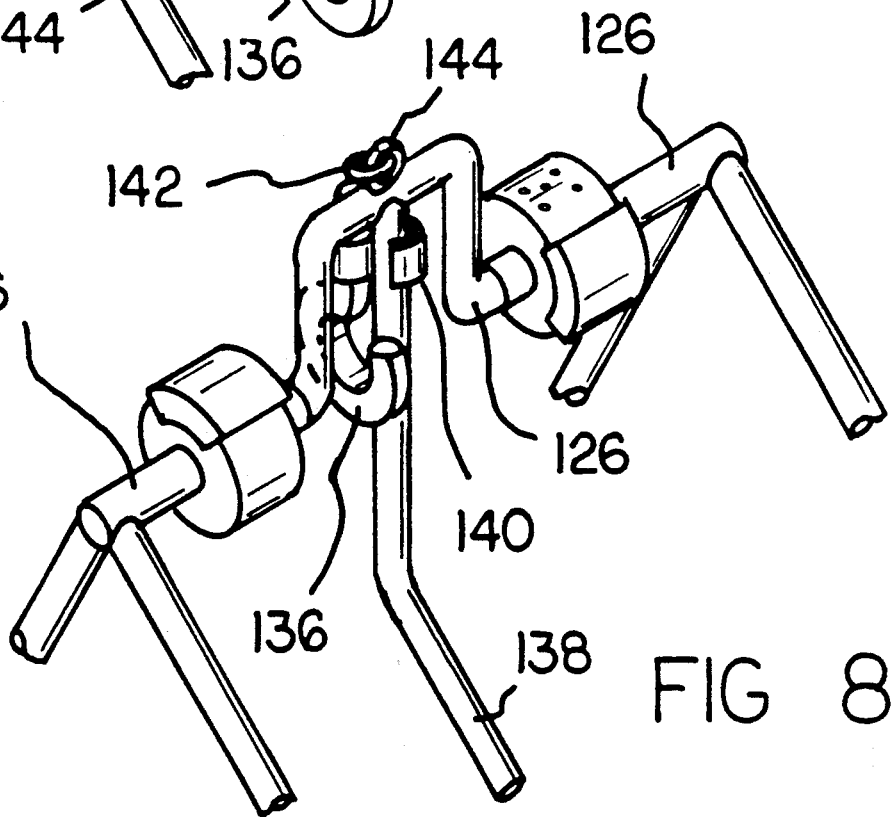
FIG. 8 is a perspective view of the alternative embodiment of FIG. 7 of the framework cross bar having a bar for lifting a kettle away from the heat shown in the up and away from the heat position in accordance with the present invention.

FIGS. 7 and 8 show another alternative embodiment of the present invention having a lifting rod 138 for moving a kettle away from the heat. The FIG. 7 and 8 alternative embodiment has an alternative embodiment top bar 126 with rotating middle section 126' and an alternative embodiment kettle supporting hook 136. The hook 136 has a clasp 140 at its base. The hook 136 is loosely fixed to a ring 142 at the end its base. A second ring is rigidly fixed to the bottom of the rotating middle piece 126' of bar 126 underneath where the lifting rod 138 intersects the rotating middle section 126' of the bar 126.

The alternative embodiment shown in FIGS. 7 and 8 can be easily used to move a kettle away from the heat. The apparatus is shown in the kettle down close to the heat position (shown without a kettle) in FIG. 7. The apparatus is shown in the kettle moved away from the heat (again without a kettle) in FIG. 8. The apparatus is easily switched between the two positions. To move from the FIG. 7 position to the FIG. 8 position, the lifting bar 138 is pulled down and the clasp 140 is locked around the lifting bar 138. The pulling of the lifting bar 138 down causes the rotating bent middle section 126' to shift 180 degrees from a down position to an up position effectively lifting a kettle with it. By holding the bar 138 and unlocking clasp 140, the apparatus can be gently lowered back into to its down position.

While the invention has been described using a propane burning gas source, other heat sources could be alternatively used within the scope of the invention. For example, a charcoal holder similarly shaped to the above described gas burner base could be used to burn charcoal to provide heat for cooking for use with the present invention.

It is apparent from the above that the present invention accomplishes all of the objectives set forth by providing a new cooking device made up of the following: a separate shelf means; a framework having a plurality of different location supports for supporting the shelf means, the framework also having a cross-bar near the frameworks top; a hook adapted to hang from near the center of the cross-bar; whereby foods can be cooked by a heat source positioned under the food in a variety of different cooking methods using the apparatus. The cooking apparatus can have a heat source of burning propane gas. The cooking apparatus can further comprise a specially adapted propane burner having a sturdy base and able to support other cooking devices resting on the top of the burner. The hook can be adapted to support a filled old-fashioned type kettle. The cooking apparatus can be alternately used for boiling, steaming, frying, deep frying, stewing and grilling. The cooking apparatus can further comprise salt and pepper holders adapted to be supported by the cross-bar, the salt and pepper holders adapted to release salt and/or pepper onto food cooking below. The cooking apparatus can further comprise a means for moving an object cooking away from the heat source.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A multi-purpose cooking apparatus comprising:

a first frame member, said first frame member being generally U-shaped to define a pair of legs and a cross-bar extending orthogonally between said legs, a second frame member, said second frame member being generally U-shaped to define a pair of legs and a cross-bar extending orthogonally between said legs, said first and second frame members being spaced apart to define a framework defining a cooking space between said first and second U-shaped frame members with the corresponding cross bars thereof being parallel to each other and above said cooking space, and with the corresponding legs thereof being parallel to each other on either side of said cooking space, respectively, a first cross-piece member extending orthogonally between said first and second frame members and being connected between one pair of opposed legs thereof, a second cross-piece member extending orthogonally between said first and second frame members and being connected between another pair of opposed legs thereof, said first and second cross-piece members defining support means for a shelf adapted to extend between said first and second frame members above said cooking space, first and second spaced truss members positioned at an angle to said cross-bar of said first frame member so as to extend above said cooking space, third and fourth spaced truss members positioned at an angle to said cross-bar of said second frame member so as to extend above said cooking space, said first, second, third and fourth truss members being connected to a top bar extending parallel to said cross-bar of said first frame member and to said cross-bar of said second frame member such that said top bar is supported between said first and second frame members above said cross-bars thereof and said cooking space, and hook means on said top bar to support a cooking utensil extending downwardly from said top bar within said framework and above said cooking space.

2. The cooking apparatus of claim 1 wherein said top bar includes at least one container supported thereon for storing cooking seasoning substance therein, said container including actuatable release means for discharging a predetermined amount of said substance toward said cooking space below said top bar.

3. The cooking apparatus of claim 1 wherein said top bar includes a section adapted to be rotated about an axis passing coaxially through said bar, said hook being mounted on said rotatable section.

4. The cooking apparatus of claim 3 wherein said rotatable section is mounted in an offset manner to the remainder of said top bar to form a crank, and bar means connected to said crank such that said offset section and said hook may be rotated relative to said axis by actuation of said bar means to move said hook away from said cooking space.

* * * * *